US007926669B2

(12) United States Patent
Alvarado

(10) Patent No.: US 7,926,669 B2
(45) Date of Patent: Apr. 19, 2011

(54) RACK FOR HOLDING PACKS OF PLASTIC BAGS

(75) Inventor: Rafael A. Alvarado, Houston, TX (US)

(73) Assignee: Better Bags, Inc., Houston, TX (US)

( * ) Notice: Subject to any disclaimer, the term of this patent is extended or adjusted under 35 U.S.C. 154(b) by 330 days.

(21) Appl. No.: 11/320,046

(22) Filed: Dec. 28, 2005

(65) Prior Publication Data

US 2006/0102573 A1 May 18, 2006

Related U.S. Application Data

(63) Continuation-in-part of application No. 10/814,469, filed on Mar. 31, 2004, now abandoned.

(51) Int. Cl.
*A47G 29/00* (2006.01)

(52) U.S. Cl. ..... 211/85.15

(58) Field of Classification Search ..... 211/59.1, 211/13.1, 85.15, 85.31, 12, 133.2, 133.5, 211/49.1, 119; D6/515; 206/554; 248/95, 248/97, 99

See application file for complete search history.

(56) References Cited

U.S. PATENT DOCUMENTS 3,361,294 A * 1/1968 Bjerum ..... 221/26
3,995,744 A * 12/1976 Metcalf ..... 211/131.1
4,289,246 A * 9/1981 Scott ..... 211/205
4,723,743 A * 2/1988 Jenkins ..... 248/97
4,819,899 A * 4/1989 Weil ..... 248/97
4,948,075 A * 8/1990 Allen ..... 248/97
4,974,746 A * 12/1990 Dickinson ..... 220/495.09
5,018,691 A * 5/1991 King ..... 248/99
5,020,750 A * 6/1991 Vrooman et al. ..... 248/97
5,033,703 A * 7/1991 Allen, Sr. ..... 248/97
5,195,643 A * 3/1993 Rocco ..... 211/59.2
5,269,416 A * 12/1993 DeMatteis ..... 211/50
5,419,437 A * 5/1995 Huseman ..... 206/554
5,732,833 A * 3/1998 Alvarado et al. ..... 211/59.1
5,765,789 A * 6/1998 Ryon et al. ..... 248/97
5,871,115 A * 2/1999 Kohn ..... 220/485
5,885,002 A * 3/1999 Reiss ..... 383/37
5,941,393 A * 8/1999 Wilfong, Jr. ..... 206/554
6,059,126 A * 5/2000 Miller ..... 211/85.15
6,065,233 A * 5/2000 Rink ..... 40/607.1
D435,379 S * 12/2000 Nguyen ..... D6/515
6,505,750 B1 * 1/2003 Nguyen ..... 211/163
6,585,197 B1 * 7/2003 Daniels ..... 248/97
6,648,153 B2 * 11/2003 Holmes ..... 211/85.15
6,651,832 B1 * 11/2003 Nguyen ..... 211/163
6,729,483 B1 * 5/2004 Nguyen et al. ..... 211/163
7,175,139 B2 * 2/2007 Broeders ..... 248/95
7,243,884 B2 * 7/2007 Lawson et al. ..... 248/95
7,287,654 B2 * 10/2007 Nguyen et al. ..... 211/163
2002/0079247 A1 * 6/2002 Wilfong, Jr. ..... 206/554
2003/0205497 A1 * 11/2003 Strickland ..... 206/554
2004/0256279 A1 * 12/2004 Nguyen et al. ..... 206/554
2005/0218093 A1 * 10/2005 Alvarado ..... 211/59.1
2006/0021956 A1 * 2/2006 Wilfong, Jr. ..... 211/59.1
2006/0102573 A1 * 5/2006 Alvarado ..... 211/85.15
2007/0095989 A1 * 5/2007 Spater et al. ..... 248/100
2008/0053929 A1 * 3/2008 Nguyen et al. ..... 211/50

* cited by examiner

*Primary Examiner* — Sarah Purol

(74) *Attorney, Agent, or Firm* — Triantaphyllis Law Firm; Anastassios Triantaphyllis

(57) ABSTRACT

A rack for hanging four packs of different sized plastic bags of the type having an upper disposable portion and a lower bag portion.

20 Claims, 3 Drawing Sheets

RACK FOR HOLDING PACKS OF PLASTIC BAGS

RELATED APPLICATIONS

The present application is a Continuation-In-Part of U.S. patent application Ser. No. 10/814,469, filed Mar. 31, 2004 now abandoned, entitled "Rack for Holding Packs of Plastic Bags".

BACKGROUND OF THE INVENTION

1. Field of the Invention

The present invention relates to a rack for holding four packs of different sized plastic bags of the type having an upper disposable portion and a lower bag portion. The present invention further comprises at least one L shaped support member designed to support the bottoms of the plastic bags while being loaded.

2. Description of the Related Art

In supermarkets and other retail outlets, there is frequently the need for consumers or store employees to place items in bags to facilitate handling and purchase. For example, produce bags are dispensed directly to customers wherein the customer can bag produce as it is chosen for purchase. Also, in deli or meat departments, store employees place meats and other deli products in bags for the consumer. Further, in bakery departments, store employees place the selected bakery products in bags for the consumer. In the prior art, there are a number of designs for dispensing bags for these purposes.

Roll mounted produce bags or loose bags are commonly found in modern grocery stores and supermarkets. The roll bags are designed for customers to use when purchasing fresh produce; typically, the loose bags are used by other departments, including bakery packaging. The bags currently available are difficult for customers to use for several reasons. First, the bags tend to cling together and are difficult to separate from the roll. Second, is difficult to tell the open end of the bags from the closed end of the bag. Third, the bags are difficult to open as the sides tend to cling together due to static. Fourth, sometimes all of the bags are of the same size, limiting the user's ability to choose different sized bags. Fifth, with loose bags, the user has to continually bend down to pick up single bags from the boxes.

U.S. Pat. No. 5,732,833, commonly owned by applicant, discloses a dispensing assembly for supporting packs of plastic bags. The packs of plastic bags include a disposable upper portion connected to a lower bag portion. This patent shows dispensing assemblies for supporting two and three packs of plastic bags. With these dispensing assemblies, if packs of different sized plastic bags were hung on the dispensing assemblies, the visual presentation would be disorganized and would not be acceptable.

Thus, there are a number of shortcomings with the known rolls of plastic bags, packs of plastic bags and loose plastic bags. A common problem with bag dispensing systems is providing different sized bags to the user in a visually appealing fashion and in a manner that increases packaging efficiency.

SUMMARY OF THE INVENTION

Accordingly, a need has arisen for a rack for holding four packs of different sizes of plastic bags.

In accordance with present invention, a rack is provided for holding four packs of different sized plastic bags, comprising:

a rectangular platform having four sides, each side having at least one hook for hanging at least one pack of plastic bags, a base, and at least one vertical member connecting the platform and the base, at least one L shaped support member which hangs on the at least one hook on a side of the platform and is designed to support the bottoms of the plastic bags.

Accordingly, an object of the present invention is to provide a rack for holding packs of different sized plastic bags in a visually appealing manner and in a manner that increases packaging efficiency.

BRIEF DEDSCRIPTION OF THE DRAWINGS

A better understanding of the invention can be obtained when the detailed description of exemplary embodiments set forth below is considered in conjunction with the attached drawings in which.

DETAILED DECRIPTION OF THE EXEMPLARY EMBODIMENTS

The present invention relates to a rack for holding four packs of different sized plastic bags. While the racks and packs of plastic bags may be used for any purpose, the preferred use of the racks and packs of plastic bags is at a bakery counter. With the preferred use, a consumer selects a bakery good and the bakery store employee selects a bag size from the four packs of different sized plastic bags and places the bakery goods in the bag, removes and seals the bag, and provides the bag with the bakery products to the customer.

Figure 1:
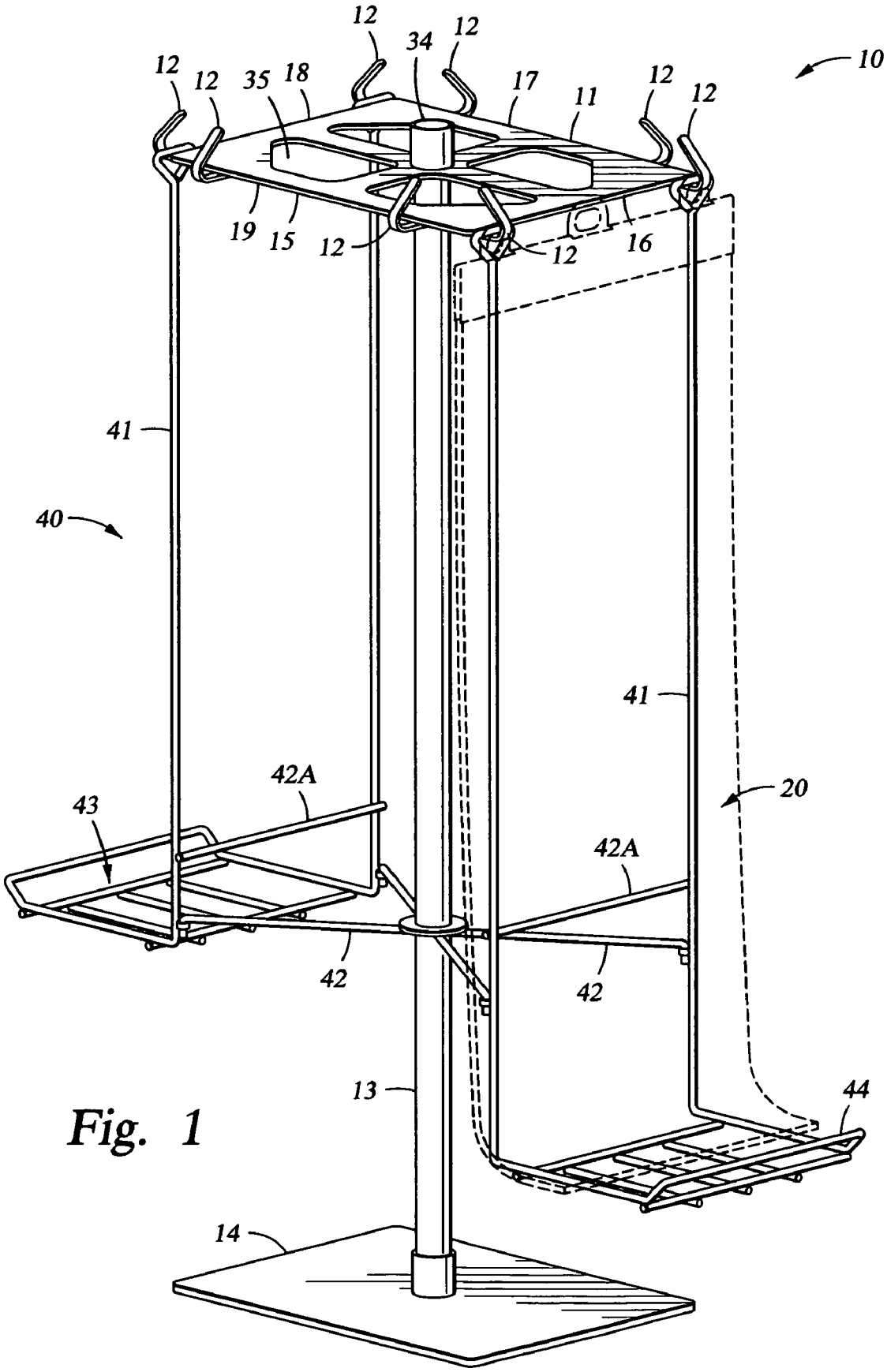
FIG. 1 is a perspective view of an embodiment of the present invention.

With reference to FIG. 1, a rack 10 (also referred to as a bag dispensing assembly) is shown having a platform 11, a plurality of hooks 12, at least one vertical member 13, and a base 14. The platform 11 has a bottom surface 15, a first side 16, a second side 17, a third side 18, and the fourth side 19. The hooks 12 are attached to the bottom surface 15 of the platform 111 at each of the four sides 16, 17, 18 and 19. The rack 10 also comprises at least one L shaped support member 40 which supports the bottoms of the plastic bags. Packs of plastic bags 20 are shown hanging on the hooks 12 on sides 16 and 18 with the bottoms of the plastic bags being supported by L shaped support members 40.

The platform 11 is preferably rectangular shaped, formed from a sheet of material, and oriented in a horizontal manner on the vertical member 13. While the platform 11 may be formed in any suitable way, preferably, the platform 11 has a central member 34 which allows rotation about the vertical member 13. As shown, the central member 34 is cup shaped and fits on top of the vertical member 13 with the top portion of the vertical member 13 fitting within the cup shaped central member 34 and the diameter of the vertical member 13 below the platform 11 being greater than the diameter of the cup shaped central member 34 such that the central member 34 sits on and rotates about the vertical member 13. Also, preferably, the platform 11 has a central opening section 35. The central opening section 35 serves to reduce the weight of platform 11 to help prevent a tip over and the damage or injury to occur if the device 10 were to tip over. The central opening section 35 also serves to present the packs of plastic bags in visually appealing manner and to aid the user in seeing the packs of different sized plastic bags 20 such that he may choose an appropriately sized plastic bag.

The hooks 12 are generally constructed from a rod, or flat, thick wire, or thin plate bent into a V shape. As shown, the hooks 12 generally project at an angle of about 45 degrees to the platform 11. Preferably, the hooks 12 extend beyond the end of the platform 11. Preferably, a pair of hooks 12 is spaced 8 inches apart.

The L shaped support member 40 has a longer leg and a shorter leg; the longer leg comprises at least one rod 41; preferably there are two rods 41, each rod 41 hanging downwardly from each hook 12 on a side of the platform 11. The shorter leg comprises a bottom support 43 which may be any generally horizontal structure which will support the bottoms of the bags. The bottom support 43 serves to ensure that the bags' seals, while being loaded in the rack, do no burst or split at the bottom. FIG. 1 shows the bottom support 43 as a wire rack. Preferably, the bottom support 43 includes a lip 44 which serves to deter the bottom of the bags from moving forward while being loaded. The two rods 41 may be connected by a rod connector system 42, 42*a*. The rod connector system 42, 42*a* serves several functions; first, it serves to stabilize and strengthen the L shaped support member 40; second, it serves to prevent the bottom of the bags from being pushed through the rods 41; third, it serves to prevent the L shaped support member(s) 40 from swaying back and forth on the hooks 12.

The rack 10 is designed to stand on the floor. The vertical member 13 is preferably a rod or leg which supports the platform 11 in an elevated position, preferably at about the waist of the user. While preferably the vertical member 13 is one rod or leg, it is possible that multiple vertical members 13 could be used, for example, four vertical members 13 could support the platform 11. While the vertical member 13 is shown as a round tubular member, it can also be made in other shapes, for example, from square tubular material. The base 14 may be any suitable base for holding the rack 10 in an upright position. While the base 14 is shown as a flat plate, it is to be understood that the various other types of bases could be used and are contemplated as being within the scope of the present invention.

The rack 10 may be constructed of any suitable materials including, for example, stainless steel, plastic, or acrylic. Additionally, different parts of the rack 10 may be constructed of different materials, for example, the platform 11 may be constructed of stainless steel while the vertical member 13 is constructed of plastic.

Figure 2:
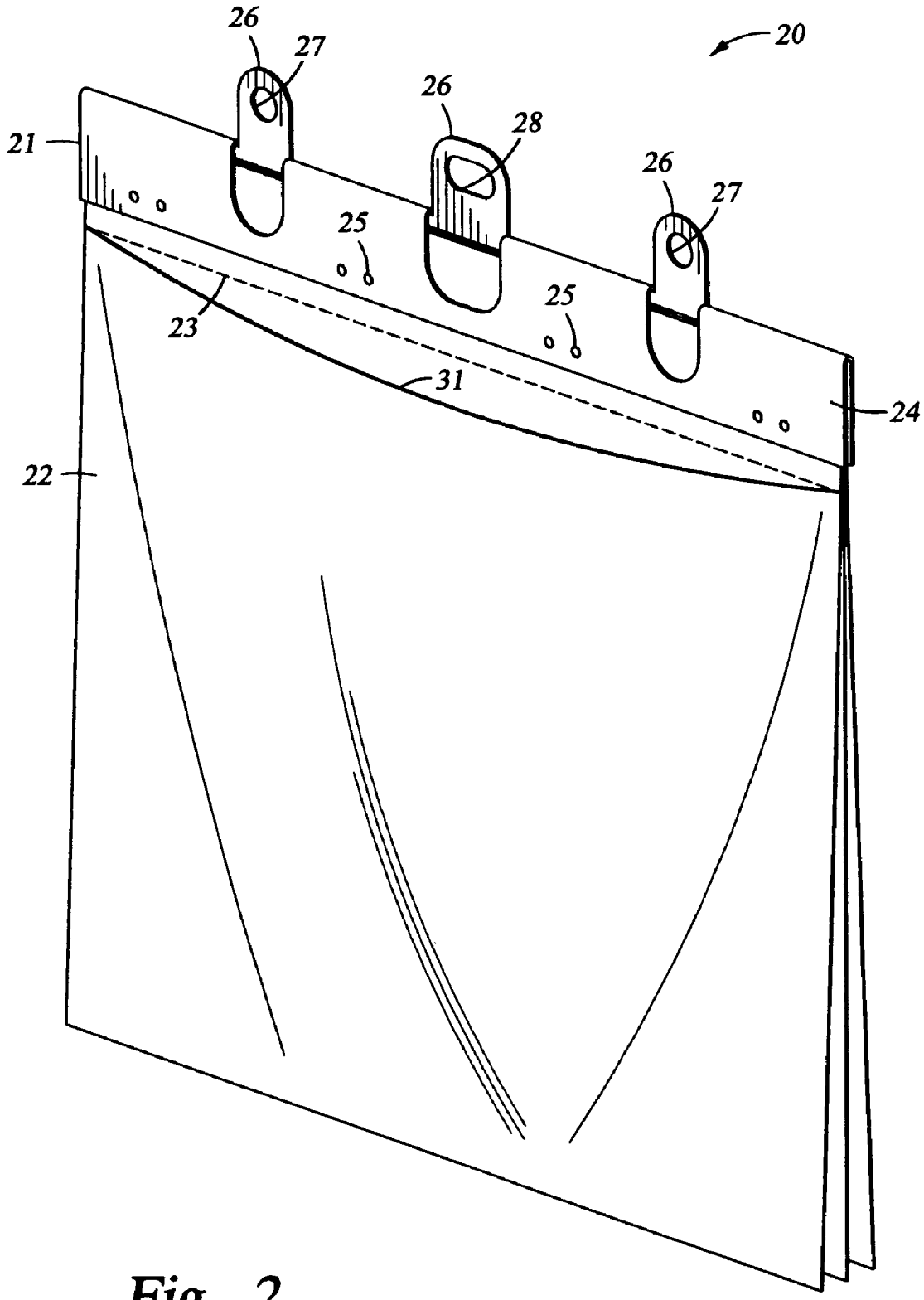
FIG. 2 is a front view of a pack of plastic bags having a header with tabs for attaching the pack to at least one support hook.
Figure 3:
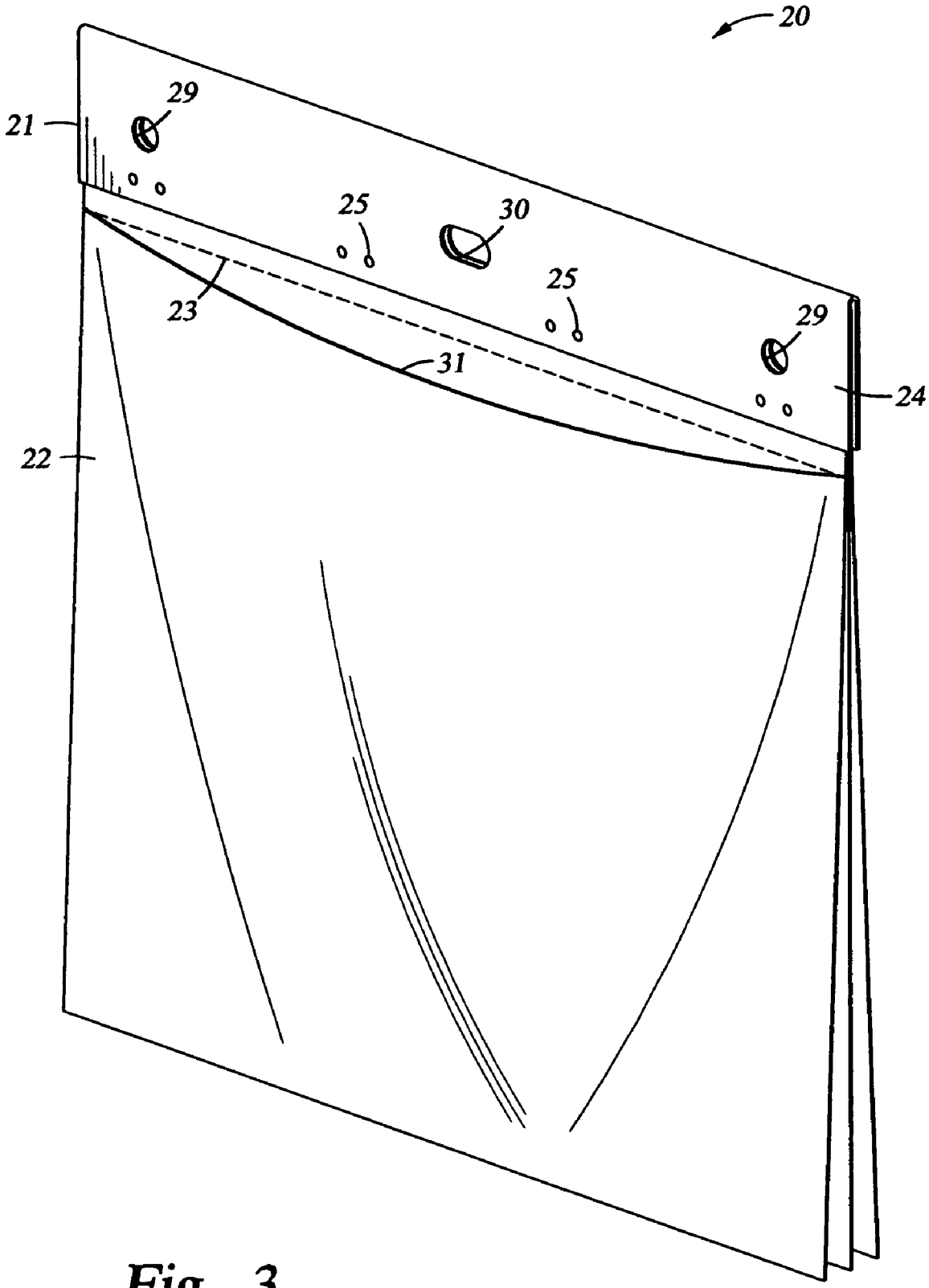
FIG. 3 is a front view of a pack of plastic bags having a header with holes through the header for attaching the pack to at least one support hook.

FIGS. 1, 2 and 3 show packs of bags 20 wherein a number of individual bag units are joined together to form the pack 20. The individual bag units have a disposable upper portion 21 and a lower bag portion 22 with a seration 23 between the disposable upper portion 21 and the lower bag portion 22. In forming the pack 20, the individual bag units are stacked on top of each other, and a header 24 is placed about the disposable upper portion 21. The header 24 and the disposable upper portions 21 are joined together in any suitable way; preferably, the header 24 is joined to the disposable upper portions 21 by inserting heated blunt rods through the header 24 and the disposable upper portions 21 to melt the header 24 and the disposable upper portions 21 together about the points of insertion 25. The insertion of the heated blunt rods serve to melt the plastic immediately adjacent to the header 24 and the disposable upper portions 21 at the points of insertion 25 to join together the header 24 and the disposable upper portions 21 of the individual bag units. In FIGS. 2 and 3, the points of insertion 25 show that small circular heated blunt rods were used to melt the plastic in the header 24 and the disposable upper portions 21; however, any shape of blunt heated rods would be suitable for this purpose. The header 24 is formed by cutting a flat, generally rectangular plastic piece and folding the rectangular plastic piece longitudinally in half to substantially cover the disposable upper portions 21.

FIG. 2 shows one embodiment of the header 24 wherein tabs 26 are cut from the header 24 (prior to folding the header 24 in half) and side holes 27 and center whole 28 are placed in the tabs 26. FIG. 3 shows another embodiment of the header 24 having side holes 29 and center hole 30. Here, the holes 29, 30 may be cut out of the header 24 and the disposable upper portions 21, or the holes 29, 30 may be formed with the use of heated to blunt rods as discussed above and as is known in the art. Preferably, the side holes 27, 29 are designed to be 8 inches apart. The side holes 27, 29 are utilized when two support hooks 12 are used; the center holes 28, 30 are utilized when one support hook 12 is used.

Alternatively, a pack of plastic bags 20 may be formed without a header 24. In this embodiment (not shown), the individual bag units are stacked on top of each other and the disposable upper portions 21 are joined together such as by inserting heated blunt rods through the disposable upper portions 21 to melt the disposable upper portions 21 together about the points of insertion. The holes for hanging on a rack may be cut out of the disposable upper portions 21 or formed with the use of heated blunt rods.

The individual bag units generally include a back sheet and a front sheet which are sealed around the sides and bottom to form the lower bag portions 22. The back sheet includes serration 23 and the disposable upper portions 21, while the front sheet terminates just below serration 23 to form a bag opening 31. The individual bag units formed with opening 31 allows a product to be placed in a bag while the bag remains attached to the pack of plastic bags 20 such that the user may then use two hands to remove the bag from the pack of plastic bags 20 and seal the bag. Thus, the bags 20 have an open front side for loading efficiency.

The material use to create the plastic bags may be any suitable plastic resin, including: low density polyethylene; linear low density polyethylene; high-density polyethylene; high molecular weight, high-density polyethylene; and polypropylene. The plastic film used to create the plastic bags may be either a single extruded layer or multiple, coextruded layers.

The present invention provides a rack 10 which is floor standing, stable, requires a minimal amount of space and is inexpensive to fabricate. It presents packs of different sized plastic bags in a neat and orderly, visually appealing manner. With the present invention, it is convenient to select the appropriate sized bag, and the rack 10 is easy to stock with packs of plastic bags.

An inventive feature of the present invention is that the rack 10 having four sets of hooks 12 allows the placement of four packs of different sized plastic bags 20 in a neat and orderly manner such that the user may select which sized bag is appropriate for the product being placed in the bag. With known racks for holding packs of plastic bags, if different sized plastic bags were hung on the racks, the packs of plastic bags would be presented in a sloppy or haphazard manner. A rectangular platform 11 having four sets of hooks 12 provides a safer and more visually appealing way to present four packs of different sized plastic bags 20 than any other known way for presenting multiple packs of plastic bags 20. Here, it is preferable to hang wider packs of plastic bags on the wider sides of the rectangular platform 11, here shown as sides 17 and 19. Also, as discussed above, preferably the platform 11 rotates about the vertical member 13 allowing the user to more easily select the appropriate sized bag.

In the bakery section of a grocery store it is advantageous to have several packs of plastic bags of different sizes, for example, long thin bags for holding French bread, and wider, shorter bags for holding muffins. The present invention provides for the presenting of four packs of different sized plastic bags allowing the user to select the appropriate sized bag for the product being placed in a bag.

The present inventive rack 10 is advantageous over known racks for holding packs of plastic bags in that it provides a neat and orderly, visually pleasing presentation of four packs of different sized plastic bags.

All patents referred to herein are hereby incorporated by reference in their entireties.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A rack for holding four packs of different sized plastic bags each plastic bag having a bottom, comprising:

a rectangular platform having four sides, each side having at least one hook for hanging at least one pack of plastic bags, four packs of different sized bags, a base, and at least one vertical member connecting the platform and the base, wherein each of the four packs of different sized plastic bags hang on the at least one hook on the side of the rectangular platform and comprise a plurality of individual bag units, the upper portion of each of the four packs of different sized plastic bags hanging vertically from the at least one hook without further support from the platform, wherein the hooks are V-shaped, at least one L shaped support member which hangs on the at least one hook on a side of the platform and is designed to support the bottoms of the plastic bags.

2. The rack of claim 1, wherein each hook is attached to a bottom surface of the rectangular platform.

3. The rack of claim 2, wherein each hook has a first leg connected to the bottom surface and a second leg projecting at an angle of about 45 degrees to the platform.

4. The rack of claim 3, wherein the first leg extends beyond the platform.

5. The rack of claim 1, wherein each side of the platform has 2 hooks.

6. The rack of claim 5, wherein the hooks on each side of the platform are spaced about 8 inches apart.

7. The rack of claim 1, wherein the platform rotates about the at least one vertical member.

8. The rack of claim 1, wherein the platform has a central open section.

9. The rack of claim 1, wherein the L shaped support member has a longer leg and a shorter leg, the longer leg comprises a rod hanging downward from each hook on a side of the platform and the shorter leg comprises a bottom support designed to support the bottoms of the plastic bags.

10. The rack of claim 9, wherein the bottom support comprises a lip designed to deter the bottom of the bags from moving in a forward direction.

11. A plastic bag dispensing assembly for dispensing plastic bags from four packs of different sized plastic bags each plastic bag having a bottom, comprising:

a horizontal platform having a bottom surface and four sides, each side having at least one hook for hanging at least one pack of plastic bags, a base, at least one vertical member connecting the platform and the base, wherein the hooks are attached to the bottom surface of the platform, wherein the hooks are bent into a V-shape, the hooks having a first leg for attaching to the platform and a second leg projecting at an angle of about 45 degrees to the platform, a first L shaped support member which hangs on the at least one hook on a first side of the platform and is designed to allow the upper portion of the plastic bags to hang vertically from the at least one hook and to support the bottoms of the plastic bags, a second L shaped support member which hangs on the at least one hook on a second side of the platform and is designed to allow the upper portion of the plastic bags to hang vertically from the at least one hook and to support the bottoms of the plastic bags.

12. The plastic bag dispensing assembly of claim 11, wherein the hooks on each side of the horizontal platform are designed to hang the four packs of different sized plastic bags.

13. The rack of claim 11, wherein the first leg extends beyond the platform.

14. The rack of claim 11, wherein the platform rotates about the at least one vertical member.

15. The rack of claim 1, wherein the L shaped support member has a longer leg and a shorter leg, the longer leg comprises a rod hanging downward from each hook on a side of the platform and the shorter leg comprises a bottom support designed to support the bottoms of the plastic bags.

16. The rack of claim 15, wherein the bottom support comprises a lip designed to deter the bottom of the bags from moving in a forward direction.

17. An assembly for dispensing plastic bags, comprising:

a top having at least two sides, each side having at least one hook for hanging at least one pack of plastic bags;

a first pack of bags comprising a plurality of individual plastic bags;

a second pack of bags comprising a plurality of individual plastic bags;

a base;

a member connecting the top and the base; and at least one L shaped support member which hangs on the at least one hook on a side of the platform and is designed to support the bottoms of the plastic bags wherein each of the first pack of bags and the second pack of bags hang on the at least one hook on the side of the top with their upper portion hanging vertically from the at least one hook without further support from the top.

18. The assembly of claim 17 wherein the size of the plastic bags in the first pack of bags is different from the size of the plastic bags in the second pack of bags.

19. The assembly of claim 17 wherein the top has three sides and further includes a third pack of plastic bags hanging on the at least one hook on the side of the top with their upper portion of hanging vertically from the at least one hook without further support from the top.

20. The assembly of claim 18 wherein the top has four sides and further includes a fourth pack of plastic bags hanging on the at least one hook on the side of the top with their upper portion of hanging vertically from the at least one hook without further support from the top.

* * * * *